US008704621B2

(12) United States Patent
Hasegawa et al.

(10) Patent No.: US 8,704,621 B2
(45) Date of Patent: Apr. 22, 2014

(54) ELECTROMAGNETIC RELAY

(71) Applicant: Fujitsu Component Limited, Tokyo (JP)

(72) Inventors: Yoichi Hasegawa, Tokyo (JP); Takashi Yuba, Tokyo (JP); Daiel Iwamoto, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/869,561

(22) Filed: Apr. 24, 2013

(65) Prior Publication Data

US 2013/0285774 A1 Oct. 31, 2013

(30) Foreign Application Priority Data

Apr. 27, 2012 (JP) ..... 2012-102832

(51) Int. Cl.

| | |
|---|---|
| ***H01H 51/22*** | (2006.01) |
| ***H01H 50/02*** | (2006.01) |
| ***H01H 50/04*** | (2006.01) |
| *H01H 50/44* | (2006.01) |
| *H01H 50/14* | (2006.01) |

(52) U.S. Cl.

CPC ..... *H01H 50/021* (2013.01); *H01H 50/04* (2013.01); *H01H 50/443* (2013.01); *H01H 50/14* (2013.01)

USPC ..... 335/78; 335/83

(58) Field of Classification Search

CPC ..... H01H 50/02; H01H 50/021; H01H 50/04; H01H 50/14; H01H 50/443

USPC ..... 335/78–86

See application file for complete search history.

(56) References Cited

U.S. PATENT DOCUMENTS

| | | | |
|---|---|---|---|
| 2009/0101385 | A1 | 4/2009 | Bush et al. |
| 2011/0254645 | A1 | 10/2011 | Kubono |
| 2012/0040542 | A1 | 2/2012 | Cao et al. |

FOREIGN PATENT DOCUMENTS

| | | |
|---|---|---|
| JP | 10-269918 | 10/1998 |
| JP | 2003-152286 | 5/2003 |
| JP | 2011-228060 | 11/2011 |

OTHER PUBLICATIONS

Patent Abstracts of Japan, Publication No. 2011-228060, Published Nov. 10, 2011.

Extended European Search Report issued Aug. 7, 2013 in corresponding European Patent Application No. 13164402.3.

Patent Abstracts of Japan, Publication No. 10-269918, Published Oct. 9, 1998.

Patent Abstracts of Japan, Publication No. 2003-152286, Published May 23, 2003.

*Primary Examiner* — Ramon Barrera

(74) *Attorney, Agent, or Firm* — Staas & Halsey LLP

(57) ABSTRACT

An electromagnetic relay includes: a main body including: a first cover; an electromagnet having a first terminal extending toward the outside from a bottom surface of the first cover; and a contact portion that opens and closes according to a magnetic attractive force of the electromagnet, and has a second terminal extending toward the outside from the bottom surface of the first cover; a cable line drawn out to the outside of the electromagnetic relay; and a printed circuit board that fixes the cable line to at least one of the first terminal and the second terminal by dip soldering, and electrically connects the cable line to the at least one of the first terminal and the second terminal.

14 Claims, 14 Drawing Sheets

ELECTROMAGNETIC RELAY

CROSS-REFERENCE TO RELATED APPLICATION

This application is based upon and claims the benefit of priority of the prior Japanese Patent Application No. 2012-102832 filed on Apr. 27, 2012, the entire contents of which are incorporated herein by reference.

FIELD

A certain aspect of the embodiments is related to an electromagnetic relay.

BACKGROUND

Conventionally, there has been known an electromagnetic relay 1 that includes: an electromagnet 2 in which an iron core is attached to a reel equipped with a coil; an armature 3 that moves depending on a voltage applied to the coil; and a contact portion 4 that opens and closes with the movement of the armature, as illustrated in FIG. 1A (e.g. see Patent Document 1).

The electromagnetic relay 1 has a printed circuit board 5. As illustrated in FIG. 1B, the contact portion 4 is composed of a moving contact member 4*a* and a fixed contact member 4*b*. The moving contact member 4*a* and the fixed contact member 4*b* are made of a spring. Substrate terminals 6*a* and 6*b* of the moving contact member 4*a* and the fixed contact member 4*b* are fixed to a rear face of the printed circuit board 5, as illustrated in FIG. 1A. Tab terminals 7*a* and 7*b* are fixed to a right face of the printed circuit board 5.

Patent Document 1: Japanese Laid-open Patent Publication No. 2011-228060

SUMMARY

According to an aspect of the present invention, there is provided an electromagnetic relay including: a main body including: a first cover; an electromagnet having a first terminal extending toward the outside from a bottom surface of the first cover; and a contact portion that opens and closes according to a magnetic attractive force of the electromagnet, and has a second terminal extending toward the outside from the bottom surface of the first cover; a cable line drawn out to the outside of the electromagnetic relay; and a printed circuit board that fixes the cable line to at least one of the first terminal and the second terminal by dip soldering, and electrically connects the cable line to the at least one of the first terminal and the second terminal.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the above-mentioned technology, when a connector, not shown, is electrically connected to the electromagnetic relay 1, the cable lines which are connected to the substrate terminals 6*a* and 6*b* and are drawn out to the outside may be required. There is soldering as a method for connecting the cable lines to the substrate terminals 6*a* and 6*b*. However, when the cable lines are soldered to the substrate terminals 6*a* and 6*b* by hand, it is difficult to secure connection reliability, and manufacturing cost also rises since working man-hour increases. In addition, when both ends of the coil of the electromagnet 2 are also soldered to the cable lines drawn out to the outside, it is difficult to secure the connection reliability.

Therefore, there is a method in which the substrate terminals 6*a* and 6*b* and the tab terminals 7*a* and 7*b* are connected on the printed circuit board 5 with solder. However, since the soldering is performed on the right face and the rear face of the printed circuit board 5, automatic soldering (solder dip) cannot be employed. In this case, the cable lines have to be soldered to the substrate terminals 6*a* and 6*b* manually, so that it is difficult to secure the connection reliability.

Hereinafter, a description will be given of embodiments of the present invention with reference to the drawings.

Figure 1A:
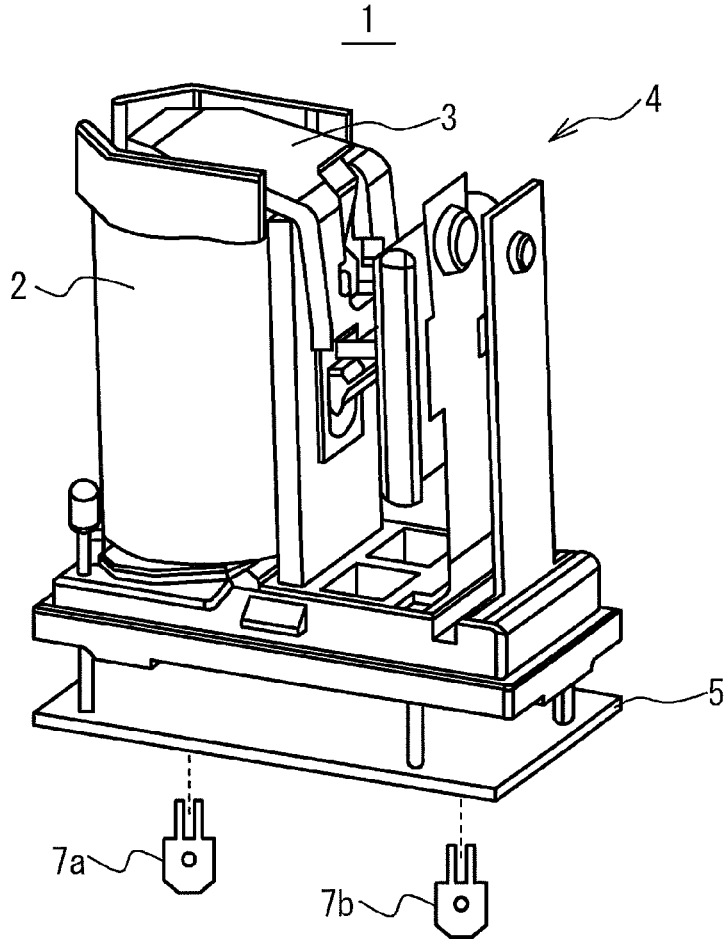
FIG. 1A is an appearance diagram illustrating the construction of a conventional electromagnetic relay.
Figure 1B:
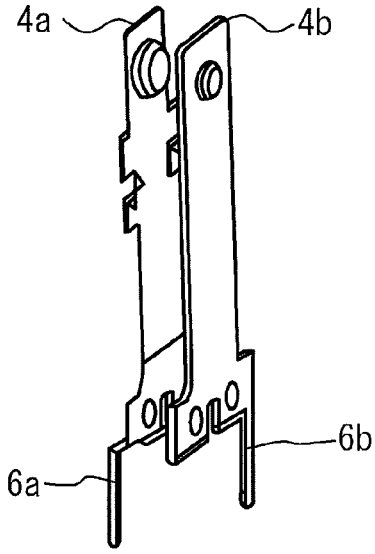
FIG. 1B is a diagram illustrating the construction of a contact portion.
Figure 2:
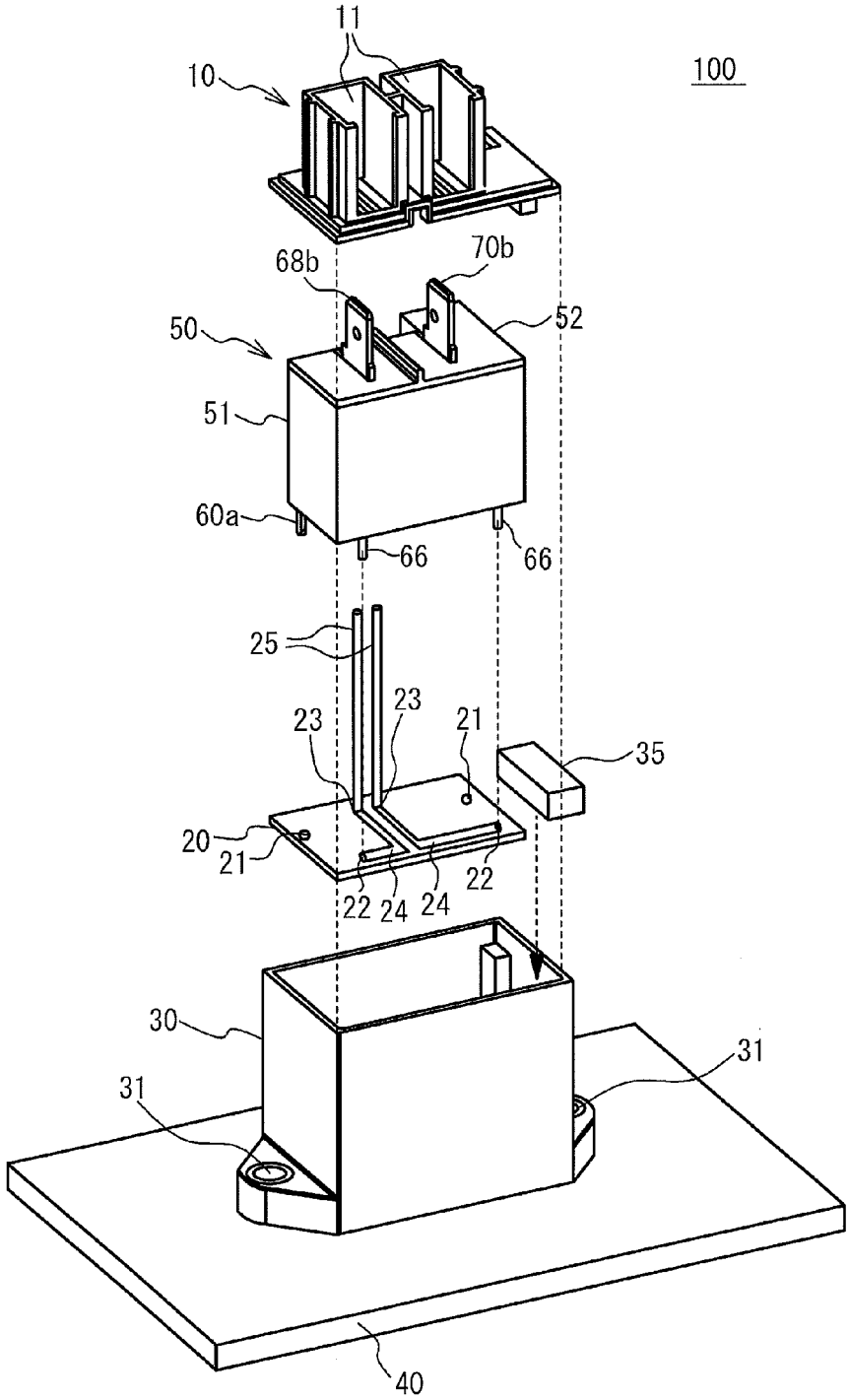
FIG. 2 is an exploded diagram of an electromagnetic relay according to the present embodiment.

FIG. 2 is an exploded diagram of an electromagnetic relay 100 according to the present embodiment. The electromagnetic relay 100 includes: an upper cover 10; a relay body 50; a printed circuit board 20; cable lines 25; an outer cover 30 as a second cover; and a permanent magnet 35. The electromagnetic relay 100 is a direct-current high voltage relay with which an electric vehicle and a hybrid vehicle and so on are equipped, for example.

The upper cover 10 covers the relay body 50. The upper cover 10 has a mounting unit 11 for mounting a socket which is coupled with tab terminals 68*b* and 70*b* of the relay body 50 described later.

The printed circuit board 20 includes: through-holes 21 for inserting substrate terminals 68*a* and 70*a* as second terminals described later; through-holes 22 for inserting coil terminals 66 as first terminals described later; and through-holes 23 for fixing the cable lines 25. Conductive parts are formed on the inner circumference of the through-holes 21 to 23. The through-holes 22 are electrically connected to the through-holes 23 by circuits 24. The coil terminals 66 which have been inserted into and soldered with the through-holes 22 are electrically connected to the cable lines 25 fixed to the through-holes 23 via the circuits 24.

The outer cover 30 houses the relay body 50, the printed circuit board 20, the cable lines 25, and the permanent magnet 35. The inside of the outer cover 30 becomes a sealed state by bonding the upper cover 10 onto the outer cover 30. The screw holes 31 for mounting the outer cover 30 on the substrate 40 near a vehicle is provided in the outer cover 30. The outer cover 30 is screwed onto the substrate 40 via the screw holes 31. For the magnetic extinction of arc, the permanent magnet 35 is mounted in the outside of the relay body 50 and in the inside of the outer cover 30.

The relay body 50 includes a base portion 52, a hollow box-shaped inner cover 51 (a first cover), the substrate terminals 68*a* and 70*a*, and the tab terminals 68*b* and 70*b*. The substrate terminals 68*a* and 70*a* are illustrated in FIGS. 3 and 4.

Since an assembly direction of respective parts is limited in an up-and-down direction as illustrated in FIG. 2, the electromagnetic relay 100 according to the present embodiment is suitable for mass production.

Figure 3:
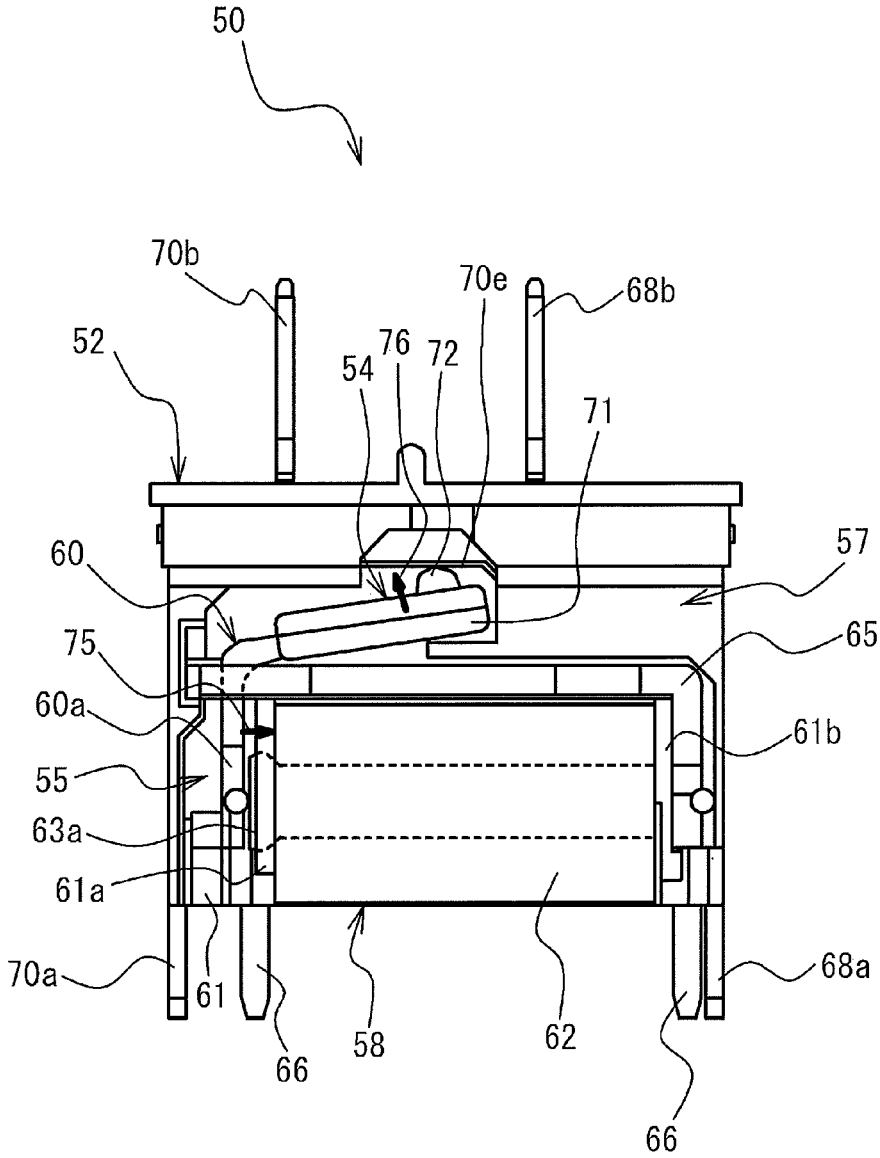
FIG. 3 is a front view of a relay body in a state where an inner cover is removed.

FIG. 3 is a front view of the relay body 50 in a state where the inner cover 51 is removed. FIG. 4 is a front view of the relay body 50 seen from an opposite direction of FIG. 3.

Figure 4:
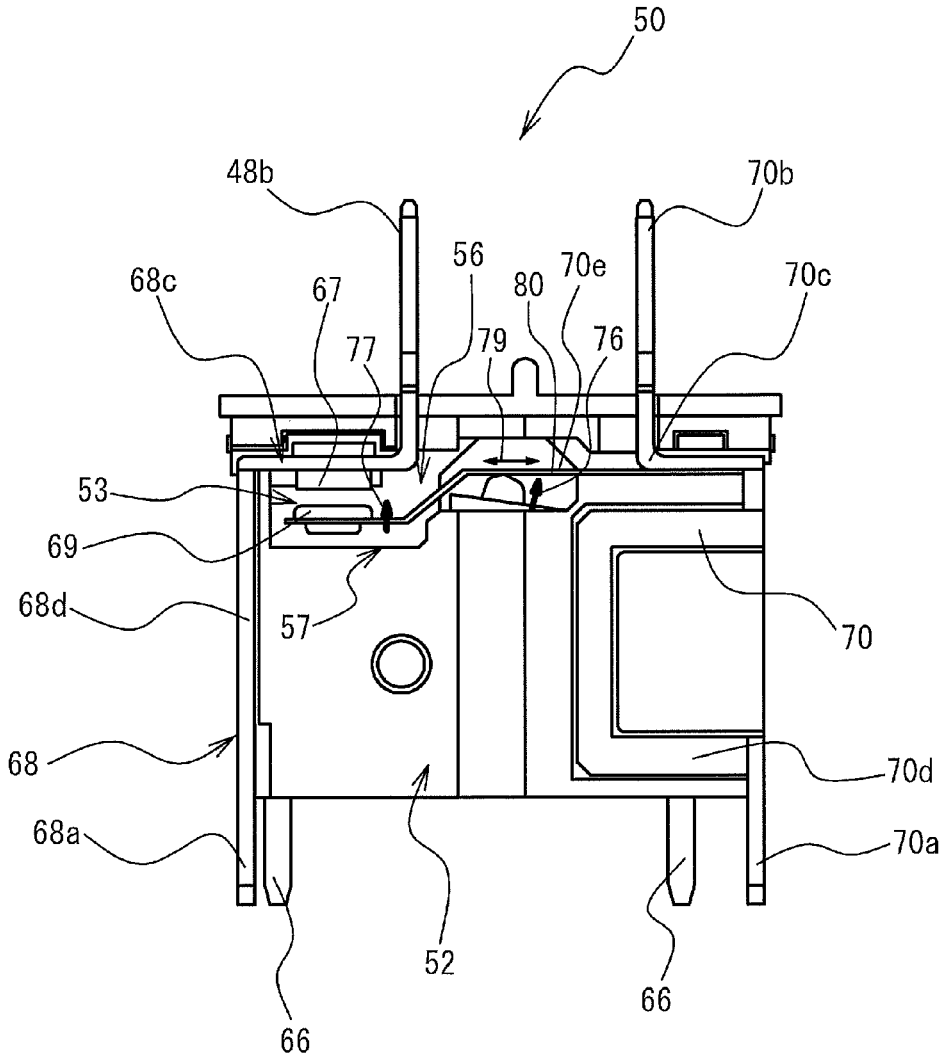
FIG. 4 is a front view of the relay body seen from an opposite direction of FIG. 3.

The substrate terminals 68*a* and 70*a* are provided on both ends of the relay body 50 respectively in order to increase connection strength with the printed circuit board 20, as illustrated in FIGS. 3 and 4. The tab terminals 68*b* and 70*b* are terminals in which a receptacle of a connector, not shown, is fitted.

The relay body 50 includes an electromagnet 58, a switch 53, a fixed contact member 68, and a moving contact member 70. The heat capacity of the fixed contact member 68 is larger than that of the moving contact member 70. The fixed contact member 68 and the moving contact member 70 are formed by punching a conductive sheet metal in a predetermined shape and bending the punched sheet metal. The substrate terminal 68*a* and the tab terminal 68*b* are parts of the fixed contact member 68, and the substrate terminal 70*a* and the tab terminal 70*b* are parts of the moving contact member 70. Therefore, the substrate terminal 68*a* and the tab terminal 68*b* are brought into conduction. The substrate terminal 70*a* and the tab terminal 70*b* are brought into conduction.

One end of the switch 53 is connected to the moving contact member 70. Another end of the switch 53 is a free end moving up and down. A fixed contact 67 which the fixed contact member 68 has contacts a moving contact 69 which the moving contact member 70 has, by action of the electromagnet 58, and hence the switch 53 becomes a closed state. The operation of the switch 53 is described later in detail.

The base portion 52 includes: a first recess portion 55 that is made of resin with electric insulation and receives the electromagnet 58; a second recess portion 56 that receives the switch 53; and a partition 57 that delimits a border between the first recess portion 55 and the second recess portion 56 which are opposed to each other.

The electromagnet 58 includes: a spool 61, a coil 62 wound around the spool 61; and an iron core 63 (i.e., a dashed line unit inside the electromagnet 58) attached to the spool 61. The spool 61 is made of resin with electric insulation, and includes; a hollow body unit (not shown); a pair of brim units 61*a* and 61*b* that are coupled to both ends of the body unit in a longitudinal direction; and a pair of coil terminals 66 that are connected to both ends of the coil 62.

The coil 62 is wound round the body unit of the spool 61, and is fixedly held between the brim units 61*a* and 61*b* of the spool 61. The iron core 63 is an approximate column-shaped member which is made of magnetic steel, for example. The iron core 63 is fixedly received in the body unit of the spool 61.

A yoke 65 that forms a magnetic path around the coil 62 is fixedly coupled with the iron core 63 of the electromagnet 58 by caulking, for example. The yoke 65 is an L-shaped board member which is made of magnetic steel, for example. A short board portion of the yoke 65 is extended along the brim unit 61*b* of the spool 61. A long board portion of the yoke 65 is arranged away from the side of the coil 62, and extended substantially in parallel with the coil 62.

An armature 60 is an L-shaped board member which is made of magnetic steel, for example. A flat plate portion 60*a* of the armature 60 is arranged in opposition to the iron core 63. The armature 60 is operated by the electromagnet 58. At the time of non-operation of the electromagnet 58, the flat plate portion 60*a* of the armature 60 is held at a position separated from the iron core 63 by a given distance. When the electromagnet 58 operates, the flat plate portion 60*a* moves toward a direction (i.e., a direction of an arrow 75) in which a bending portion of the armature 60 mainly approaches the iron core 63 according to a magnetic attractive force.

The switch 53 includes: the fixed contact 67 provided on the fixed contact member 68; and the moving contact 69 provided on the moving contact member 70. The fixed contact member 68 includes: the substrate terminal 68*a* to be fixed to the printed circuit board 20; the tabular tab terminal 68*b*; a tabular intermediate portion 68*c* that substantially intersects perpendicularly with the substrate terminal 68*a* and the tab terminal 68*b*; and a leg portion 68*d* that extends from the intermediate portion 68*c* to the substrate terminal 68*a*. The fixed contact 67 is made of desired contact materials, and is fixed to the surface of the intermediate portion 68*c* of the side of the substrate terminal 68*a* by caulking, for example.

The moving contact member 70 includes: the substrate terminal 70*a* to be fixed to the printed circuit board 20; the tabular tab terminal 70*b*; a tabular intermediate portion 70*c* that substantially intersects perpendicularly with the substrate terminal 70*a* and the tab terminal 70*b*; and a leg portion 70*d* that extends in the shape of a crank from the intermediate portion 70*c* to the substrate terminal 70*a*. A contact spring element 70*e* which is composed of a thin board, such as phosphor bronze for spring, is coupled with the intermediate portion 70*c* by caulking, for example. The contact spring element 70*e* is extended in a direction that substantially intersects perpendicularly with the substrate terminal 70*a* and the tabular tab terminal 70*b*. The moving contact 69 is made of desired contact materials, and is fixed to a free end of the contact spring element 70*e* and the surface of the contact spring element 70*e* of the side of the tab terminal 70*b* by caulking, for example.

The intermediate portion 68*c* of the fixed contact member 68 is inserted into the second recess portion 56 of the base portion 52, and is fixed to the base portion 52. The intermediate portion 70*c* and the contact spring element 70*e* of the moving contact member 70 are inserted into the second recess portion 56 of the base portion 52, and are fixed to the base portion 52. When the fixed contact member 68 and the moving contact member 70 are mounted at a proper position on the base portion 52, spaces are formed on and under the moving contact 69, and the fixed contact 67 and the moving contact 69 are arranged so as to be opposed to each other via the space on the moving contact 69.

An operation member 54 has bag structure which is made of resin with electric insulation. The operation member 54 is fixed to one end of the armature 60 opposite to another end of the armature 60 which approaches the iron core 63 of the electromagnet 58. The operation member 54 has a projection 72 projected from a side opposite to the acceptance part 71. The operation member 54 moves in a direction of an arrow 76 or a direction opposite to the arrow 76 in conjunction with oscillating movement of the armature 60 according to excitation or non-excitation of the electromagnet 58.

A description will be given of the operation of the switch 53 with reference to FIGS. 3 and 4.

When the electromagnet 58 operates, the flat plate portion 60*a* of the armature 60 moves in the direction of the arrow 75 approaching the iron core 63 against the spring power of the contact spring element 70*e* according to the magnetic attractive force. Thereby, the operation member 54 moves towards a limiting point 80 of a both-way oscillating range 79 while pushing the contact spring element 70*e*. That is, the operation member 54 elastically bends the contact spring element 70*e* in a direction of the arrow 76 so that the contact spring element 70*e* approaches the fixed contact member 68. When the flat plate portion 60*a* of the armature 60 is perfectly adsorbed to the iron core 63, the operation member 54 reaches the limiting point 80 of the both-way oscillating range 79. The moving contact 69 moves in a direction of an arrow 77 in response to the operation of the operation member 54 and the armature 60, contacts the fixed contact 67 and is electrically connected to the fixed contact 67. Thereby, the switch 53 becomes a closed state.

On the other hand, when the current flowing through the electromagnet 58 is disconnected, the magnetic attractive force is lost and the flat plate portion 60*a* of the armature 60 moves in a direction opposite to the direction of the arrow 75. Thereby, the operation member 54 moves toward a side opposite to limiting point 80 of the both-way oscillating range 79 (i.e., a left direction of FIG. 3). Thereby, the moving contact 69 moves in a direction opposite to the direction of the arrow 77, and separates from the fixed contact 67. The switch 53 becomes an opened state.

In the present embodiment, a direction in which the current flows is specified as a direction toward the fixed contact 67 from the moving contact 69. The moving contact 69 becomes a positive pole and the fixed contact 67 becomes a negative pole. In this case, arc discharge does not collide with the inner cover 51, and hence generating an organic gas which causes degradation of opening-and-closing life of the switch 53 can be prevented. Therefore, the opening-and-closing life of the switch 53 is prolonged, compared with the case where the positive pole is set to the fixed contact 67.

First Embodiment

A description will be given of a first embodiment.

Figure 5A:
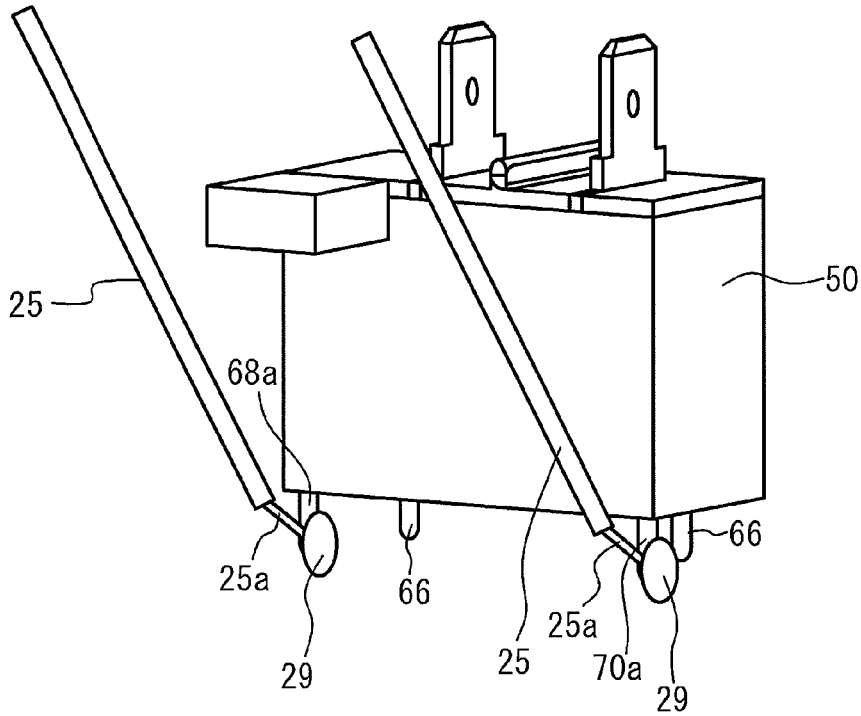
FIG. 5A is a diagram illustrating an example in which cable lines are directly connected to substrate terminals by soldering.
Figure 5B:
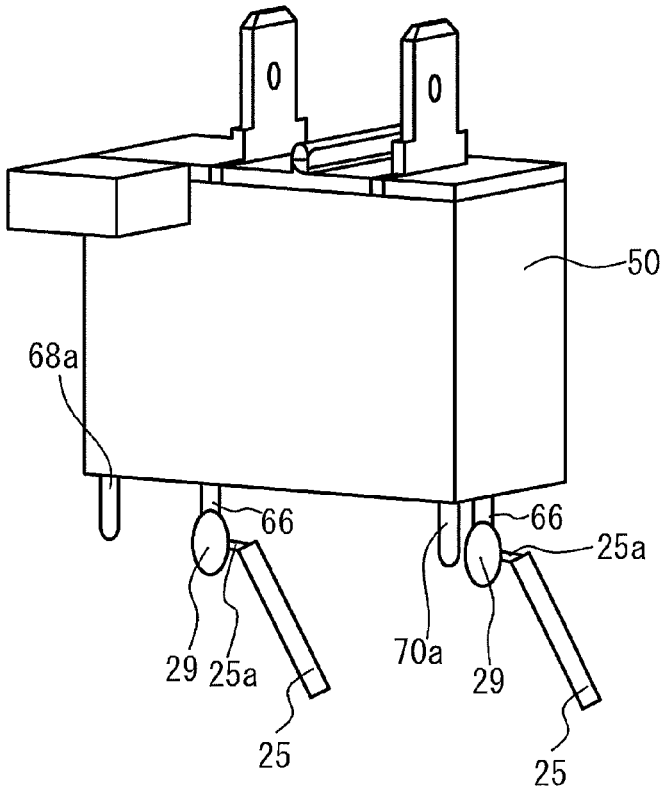
FIG. 5B is a diagram illustrating an example in which the cable lines are directly connected to coil terminals by soldering.

When the sealed type electromagnetic relay 100 is produced, conductive parts 25*a* of the cable lines 25 drawn out to the outside are directly connected to the substrate terminals 68*a* and 70*a* by soldering (i.e., solder 29), as illustrated in FIG. 5A. However, when the conductive parts 25*a* of the cable lines 25 are directly connected to the substrate terminals 68*a* and 70*a*, it is necessary to solder the conductive parts 25*a* of the cable lines 25 to the substrate terminals 68*a* and 70*a* by hand. When the conductive parts 25*a* of the cable lines 25 are soldered to the substrate terminals 68*a* and 70*a* by hand, it is difficult to secure connection reliability, and manufacturing cost also rises since working man-hour increases. Similarly, when the conductive parts 25*a* of the cable lines 25 are soldered to the coil terminals 66 by hand, as illustrated in FIG. 5B, it is difficult to secure connection reliability, and manufacturing cost also rises since working man-hour increases.

Figure 6A:
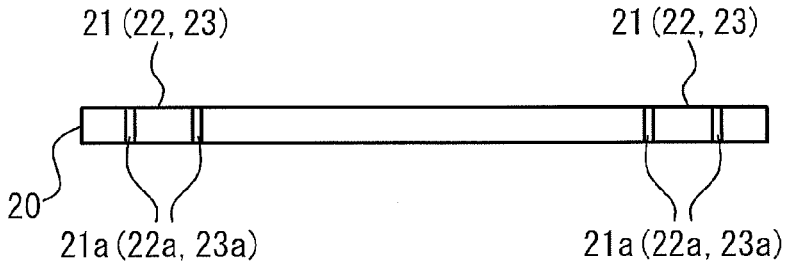
FIG. 6A is a cross-section diagram of a printed circuit board corresponding to a line passing through through-holes.

In the present embodiment, the printed circuit board 20 is prepared, as illustrated in FIG. 2. As described above, the printed circuit board 20 includes: the through-holes 21 (second through-holes) for inserting the substrate terminals 68*a* and 70*a*; the through-holes 22 (first through-holes) for inserting the coil terminals 66 described later; and the through-holes 23 (third through-holes) for fixing the cable lines 25. As illustrated in FIG. 6A, conductive parts 21*a* to 23*a* are formed on the inner circumference of the through-holes 21 to 23, respectively. FIG. 6A is a cross-section diagram of the printed circuit board corresponding to a line passing through through-holes 21 (or through-holes 22 or 23). The through-holes 22 are electrically connected to the through-holes 23 by the circuits 24.

Figure 6B:
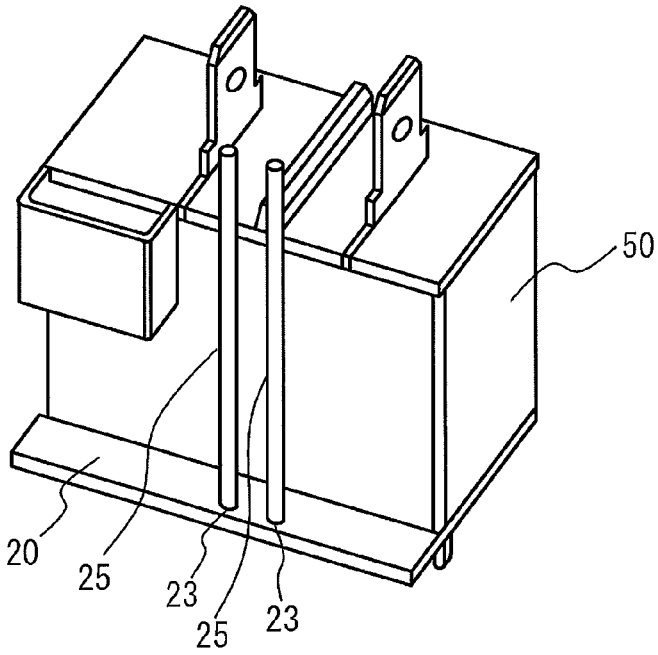
FIG. 6B is a diagram illustrating a state where the relay body and the cable lines are fixed on the printed circuit board.

Next, the relay body 50 and the cable lines 25 are installed on the printed circuit board 20. That is, the substrate terminals 68*a* and 70*a* of the relay body 50 are inserted into the through-holes 21, the coil terminals 66 are inserted into the through-holes 22, and the conductive parts 25*a* of the cable lines 25 are inserted into the through-holes 23. Then, a dip soldering device, not shown, fixes the relay body 50 and the cable lines 25 on the printed circuit board 20 by dip soldering. The soldered coil terminals 66 are electrically connected to the cable lines 25 fixed into the through-holes 23, via the circuits 24. FIG. 6B illustrates a state where the relay body 50 and the cable lines 25 are fixed on the printed circuit board 20.

Since the through-holes 21 to 23 on a rear surface of the printed circuit board 20 are soldered by dip soldering, the relay body 50 and the cable lines 25 are fixed on the printed circuit board 20 simultaneously. The dip soldering has high connection reliability because of the established construction method. Since it is unnecessary to perform soldering by hand, the rise of the manufacturing cost can be restrained.

Figure 14A:
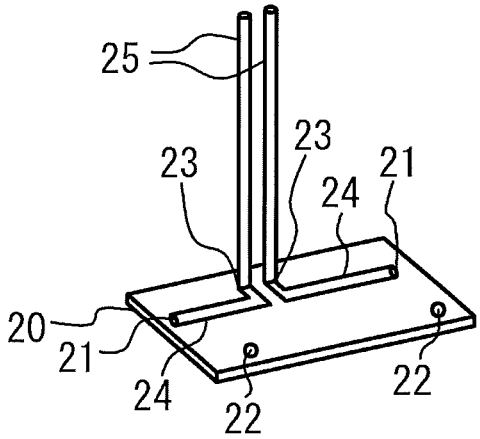
FIGS. 14A and 14B are diagrams illustrating modification examples of the printed circuit board.
Figure 14B:
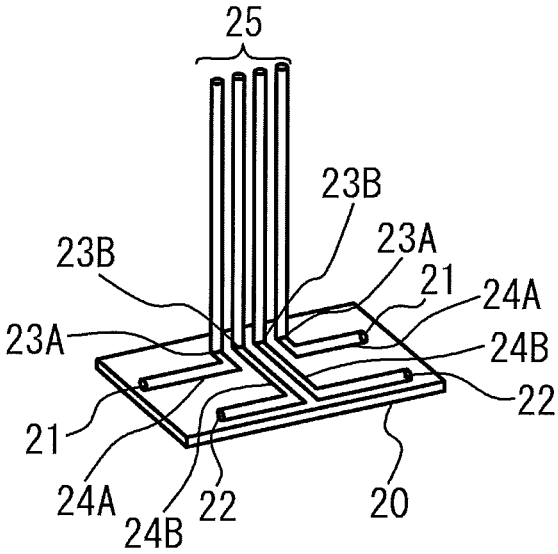

In FIG. 2, the through-holes 22 are electrically connected to through-holes 23 by the circuits 24. However, the through-holes 21 may be electrically connected to through-holes 23 by the circuits 24, as illustrated in FIG. 14A. In this case, the substrate terminals 68*a* and 70*a* are electrically connected to the cable lines 25. As illustrated in FIG. 14B, the through-holes 21 may be electrically connected to through-holes 23A by the circuits 24A and the through-holes 22 may be electrically connected to through-holes 23B by the circuits 24B. In this case, the substrate terminals 68*a* and 70*a* are electrically connected to two cable lines 25, and the pair of coil terminals 66 also are electrically connected to two remaining cable lines 25.

Here, the printed circuit board 20 is not limited to circuitry of FIGS. 2, 14A and 14B. For example, the number of through-holes 21 to 23 can be changed. Then, the printed circuit board 20 may include electronic circuits and electronic devices other than the above-mentioned circuits 24 (e.g. a filter circuit removing current noise, a voltage conversion circuit, and so on). In addition, the number of cable lines 25 is not limited to two or four.

Second Embodiment

A description will be given of a second embodiment.

Figure 7A:
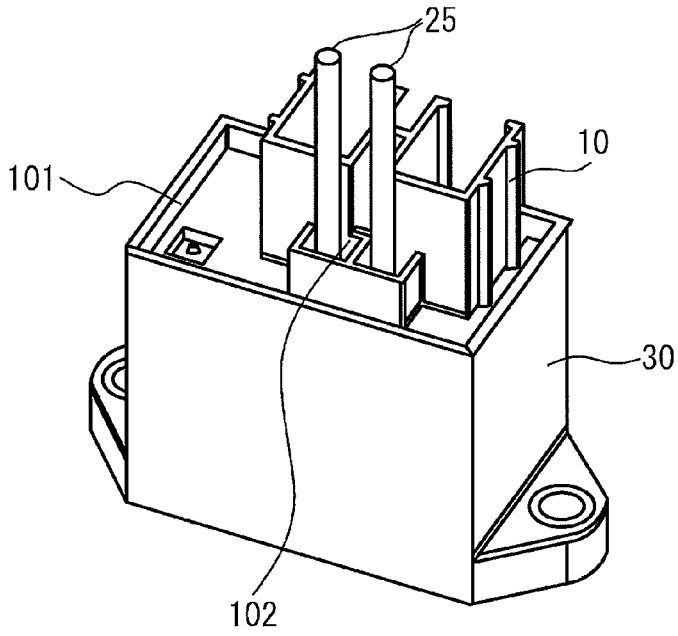
FIG. 7A is an appearance diagram illustrating the construction of the electromagnetic relay.

In order to prevent the influence of the dust and harmful gas which have a bad influence on the contact reliability of a contact point, seal structure is required of the electromagnetic relay 100 to be installed in a vehicle. Even when an adhesive is applied to a gap 101 between the upper cover 10 and the outer cover 30 and a gap 102 between the upper cover 10 and the cable lines 25, as illustrated in FIG. 7A, the airtightness of the electromagnetic relay 100 may not be secured.

Figure 7B:
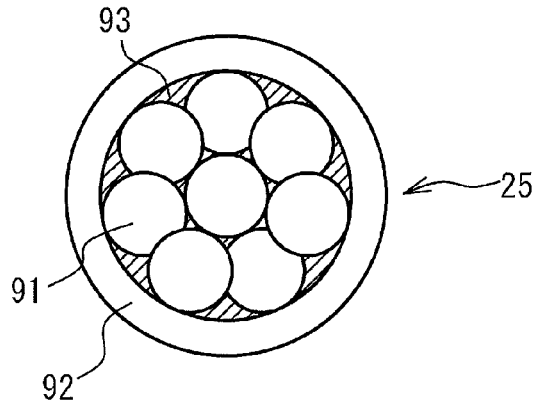
FIG. 7B is a cross-section diagram of each cable line.

For example, each cable line 25 includes a plurality of conductors 91 and an insulating coat 92 covering the conductors 91, as illustrated in FIG. 7B. Since gaps 93 exist between the insulating coat 92 and the conductors 91, the airtightness of the electromagnetic relay 100 cannot be secured.

Figure 8A:
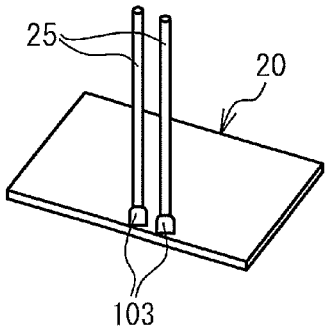
FIG. 8A is a diagram illustrating an example in which connection places between the printed circuit board and the cable lines are sealed by protective material.

Therefore, in the present embodiment, connection places of the printed circuit board 20 and the cable lines 25 are sealed by insulation protective materials 103, as illustrated in FIG. 8A. Thereby, access from the gaps 93 to the inside of electromagnetic relay 100 is obstructed, so that the airtightness of the electromagnetic relay 100 can be secured. Although insulation potting materials made of silicon or resin are used as the protective materials 103, the potting materials made of other component may be used.

Figure 8B:
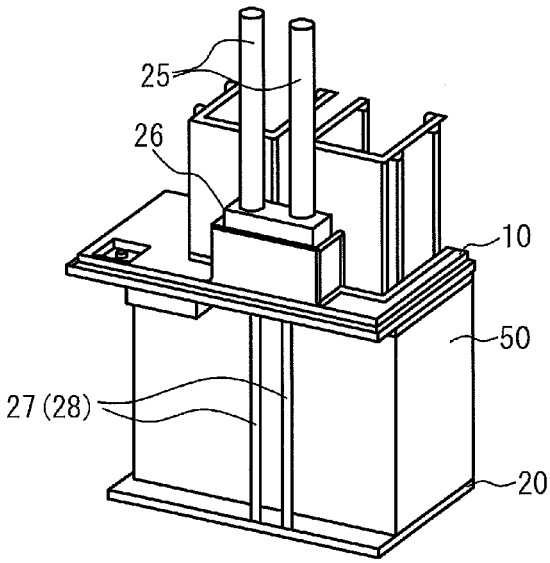
FIG. 8B is a diagram illustrating an example in which metal lines or metal plates are used instead of the cable lines.

Instead of the cable lines 25, which are covered by the outer cover 30, arranged between the printed circuit board 20 and a top end of the inner cover 51 (i.e., the upper cover 10), metal wires 27 such as tin-plated wires or metal plates 28 such as copper plates may be used, as illustrated in FIG. 8B. In this case, the metal wires 27 or the metal plates 28 has no gaps 93, and hence the airtightness of the electromagnetic relay 100 can be secured.

Figure 8C:
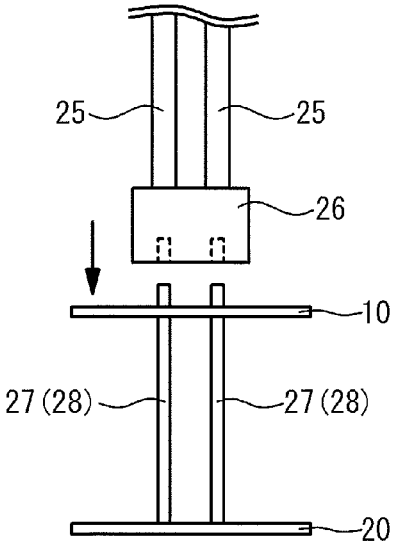
FIG. 8C is a diagram illustrating an example in which a connector mounted to ends of the cable lines is attached to the metal lines or the metal plates.

In this case, one ends of the metal wires 27 or the metal plates 28 are soldered to the printed circuit board 20 by the dip soldering, as illustrated in FIG. 8C. Another ends of the metal wires 27 or the metal plates 28 are projected above the upper cover 10. A connector 26 fixed to one ends of the cable lines 25 are attached to the another ends of the metal wires 27 or the metal plates 28, so that the cable lines 25 are electrically connected to the printed circuit board 20. After the connector 26 are attached to the another ends of the metal wires 27 or the metal plates 28, an adhesive is applied to a gap between the connector 26 and the upper cover 10.

Third Embodiment

A description will be given of a third embodiment.

In order to prevent dust from going into the inside of the relay body 50 at the time of manufacture of the electromagnetic relay 100, the relay body 50 is covered with the inner cover 51. On the other hand, the direct-current high voltage relay used in the present embodiment generates the arc discharge between the fixed contact 67 and the moving contact 69. When the arc discharge contacts the inner cover 51, an organic gas causing contact failure (i.e., poor electrical connection) is generated. Therefore, in order to cut off the arc discharge, a space (hereinafter referred to as "an arc space") which prolongs the arc discharge needs to be provided on the inner cover 51.

Figure 9A:
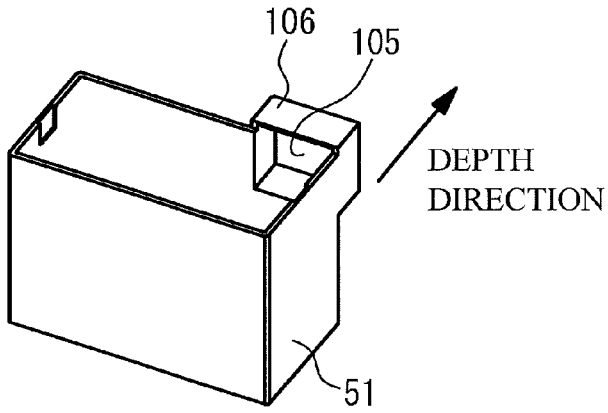
FIG. 9A is a diagram illustrating an example of the inner cover on which an arc space is formed.

Here, it is considered that an arc space 105 as illustrated in FIG. 9A is provided in the inner cover 51. In this case, the arc space 105 is integrally formed with the inner cover 51, and the wall portion 106 is formed as the upper surface of the arc space 105. Therefore, in order to form the arc space 105 of FIG. 9A, a metal mold which can slide in a depth direction of the arc space 105, i.e., a metal mold which has slide structure is required. In general, the metal mold which has slide structure is expensive.

Figure 9B:
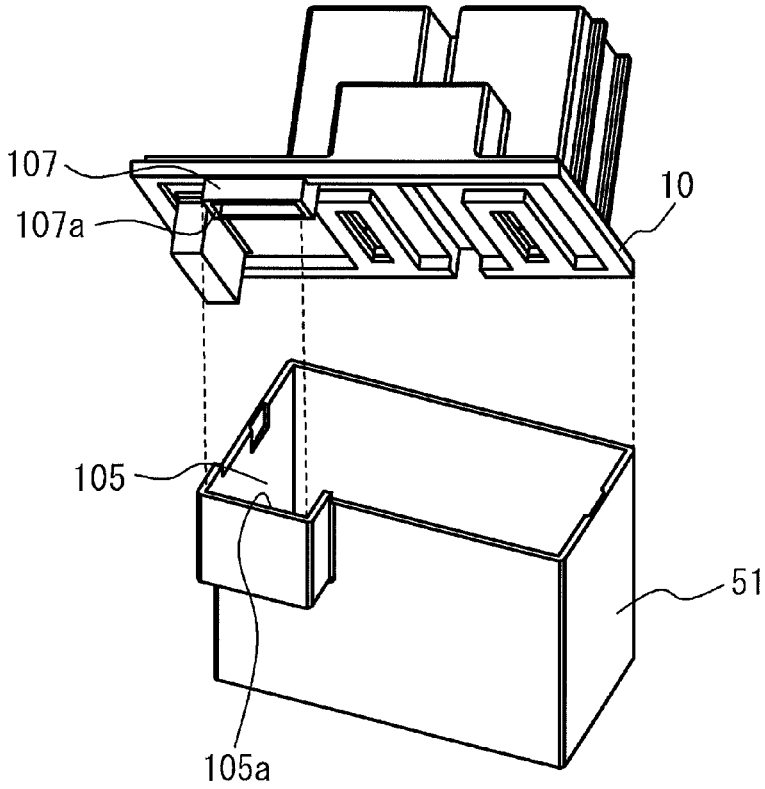
FIG. 9B is a diagram illustrating an example of an upper cover and the inner cover.

In the present embodiment, a projection portion 107 (a first projection portion) for preventing invasion of foreign substances, such as dust, is formed on the rear surface of the upper cover 10, as illustrated in FIG. 9B. Thereby, the wall portion 106 to be formed as the upper surface of the arc space 105 is removed. That is, an upside of the arc space 105 integrally formed on an upper part of the side surface of the inner cover 51 is opened. The projection portion 107 is provided at a position opposite to the arc space 105. The projection portion 107 is formed so that the outer circumference 107*a* of the projection portion 107 is attached firmly to the inner circumference 105*a* of the arc space 105 which is a part of the inner cover 51. In addition, the projection portion 107 has a height which prevents invasion of the foreign substances and in which the arc discharge does not contact the projection portion 107.

According to the present embodiment, it is possible to prevents invasion of the foreign substances, such as dust, by combination of the upper cover 10 and the inner cover 51. Moreover, the metal mold which has slide structure is not required, so that the manufacturing cost of the electromagnetic relay 100 can be reduced. Further, as compared with a case where the metal mold which has slide structure is used, the formation time of the inner cover 51 which has the arc space 105 is shortened, so that the productivity of the electromagnetic relay 100 improves.

Fourth Embodiment

A description will be given of a fourth embodiment.

As described above, when the cable lines 25 are soldered to the printed circuit board 20 by dip soldering, the cable lines 25 are in an unstable state, and hence it is difficult to perform the soldering. It is assumed that a relay unit including the relay body 50, the cable lines 25, and the printed circuit board 20 as illustrated in FIG. 6 is manufactured. In a manufacturing floor, a plurality of sets of the relay body 50 and the cable lines 25 are arranged on a single large printed circuit board, and the large printed circuit board is cut for every relay unit after the soldering. Thereby, a plurality of relay units are formed. At this time, the cable lines 25 of a certain relay unit fall over an adjoining relay unit, so that it is impossible to cut the large printed circuit board.

Therefore, in the present embodiment, a support portion for supporting the cable lines 25 is integrally formed with a side surface 51*a* of the inner cover 51 adjacent to the cable lines 25. Here, the support portion is post-attached to the side surface 51*a* of the inner cover 51. That is, the support portion may be detachable from the side surface 51*a*.

Figure 10A:
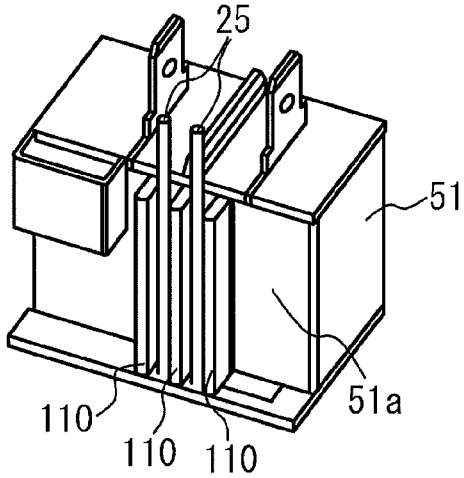
FIGS. 10A to 10C are diagrams illustrating examples of a support portion for supporting the cable lines, which is formed on a side surface of the inner cover.
Figure 10B:
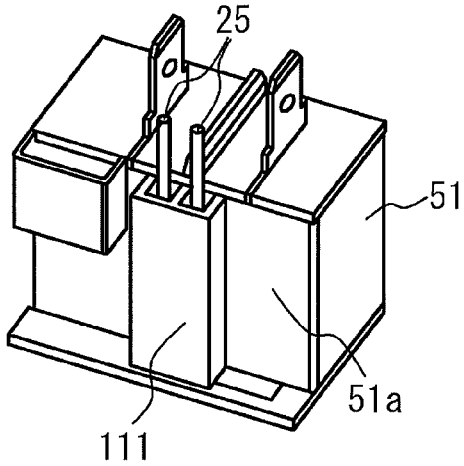
Figure 10C:
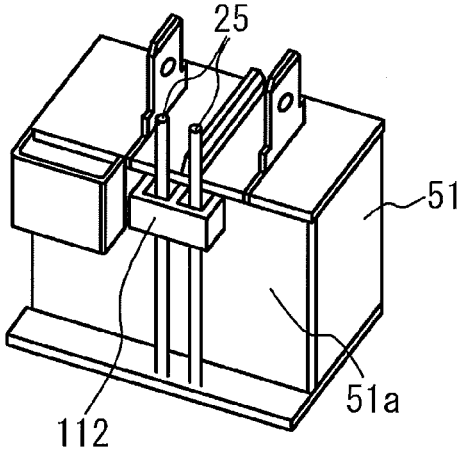

In FIG. 10A, a comb-shaped projection portion 110 (a second projection portion) for sandwiching the cable lines 25 is integrally formed with the side surface 51*a*, as the support portion. The projection portion 110 is extended in a direction away from the inner cover 51. In FIG. 10B, a tube portion 111 covering the cable lines 25 is integrally formed with the side surface 51*a*, as the support portion. The tube portion 111 is extended toward a lower end of the inner cover 51 from an upper end thereof. In FIG. 10C, a ring portion 112 supporting each cable line 25 at a point is integrally formed with the side surface 51*a*, as the support portion. The ring portion 112 is formed on the upper part of the side surface 51*a* in order to prevent the cable lines 25 from falling down.

The support portion is not limited to the projection portion 110, the tube portion 111, and the ring portion 112. Moreover, although a horizontal cross-sectional shape of the inner circumference of the tube portion 111 and the ring portion 112 is a rectangle, the horizontal cross-sectional shape may be a circle, a triangle, or a polygon.

According to the present embodiment, the support portion for supporting the cable lines 25 is integrally formed with the side surface 51*a* of the inner cover 51 adjacent to the cable lines 25, so that it is prevent the cable lines 25 from falling down. As a result, the work which solders the cable lines 25 to the printed circuit board 20 becomes easy.

Fifth Embodiment

A description will be given of a fifth embodiment.

As illustrated in FIG. 2, the outer cover 30 houses the printed circuit board 20 to which the relay body 50 and the cable lines 25 have been soldered. At this time, since the printed circuit board 20 directly contacts the outer cover 30, a contact sound of the printed circuit board 20 and the outer cover 30 occurs by vibration which arises in the relay body 50. Therefore, noise reduction of the electromagnetic relay 100 cannot be secured.

Figure 11A:
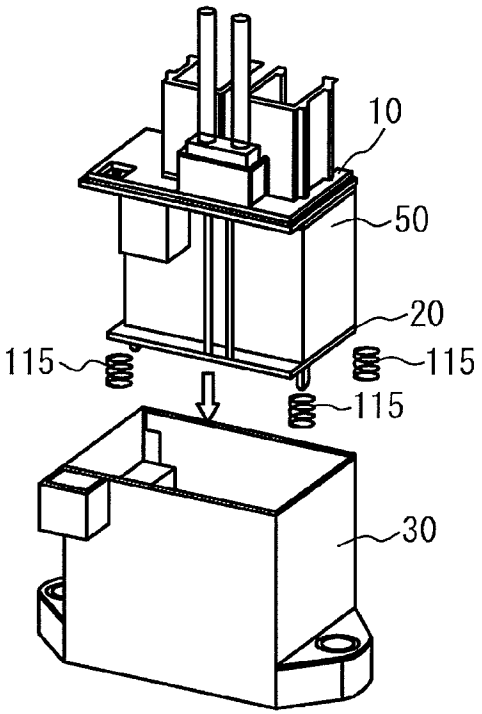
FIGS. 11A to 11C are diagrams illustrating examples of a vibration dampener provided between the printed circuit board and an outer cover.
Figure 11B:
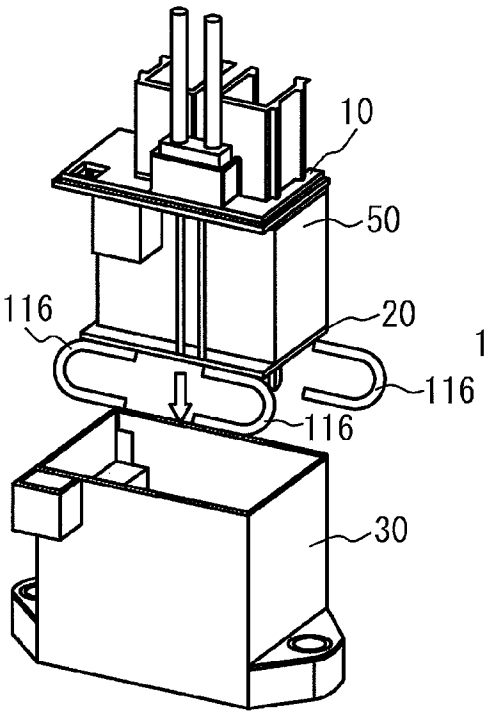
Figure 11C:
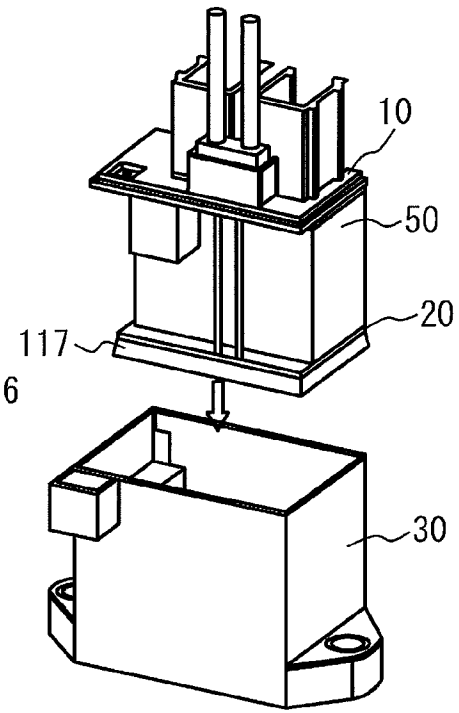

In the present embodiment, a vibration absorber for absorbing vibration which arises in the relay body 50 is provided between the printed circuit board 20 and the outer cover 30, as illustrated in FIGS. 11A to 11C. In FIG. 11A, springs 115 are used as the vibration absorber. In FIG. 11B, U-shaped springs 116 are used as the vibration absorber. In FIG. 11C, a damper 117 is used as the vibration absorber. The damper 117 is made of rubber, urethane, or silicon, but is not limited to this.

According to the present embodiment, the vibration absorber is provided between the printed circuit board 20 and the outer cover 30. Therefore, the contact sound of the printed circuit board 20 and the outer cover 30 does not occur, and hence the noise reduction of the electromagnetic relay 100 can be secured.

Sixth Embodiment

A description will be given of a sixth embodiment.

In the sealed type relay which uses a permanent magnet for the magnetic extinction, a total of two adhesion processes is required, as in the case of fixing the permanent magnet to a housing and as in the case of fixing the upper cover to the housing.

Figure 12A:
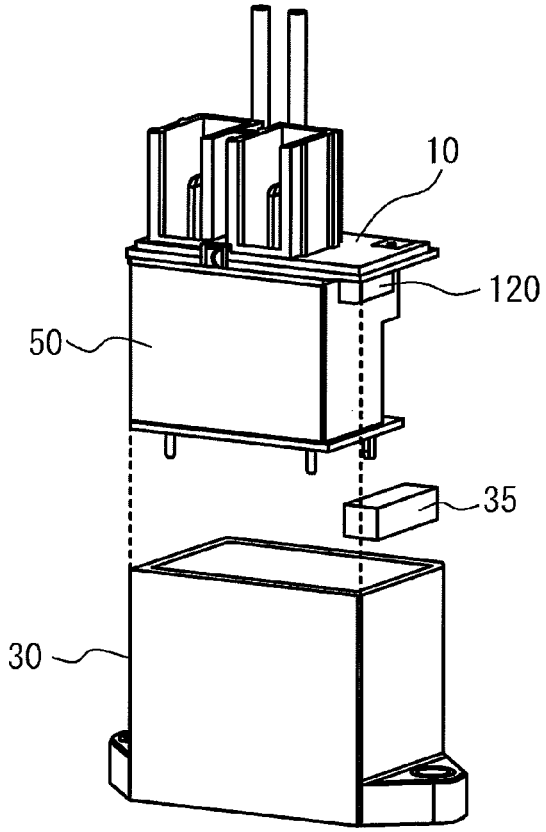
FIG. 12A is a diagram illustrating an example of the upper cover on which a projection portion for pressing down a permanent magnet is formed.
Figure 12B:
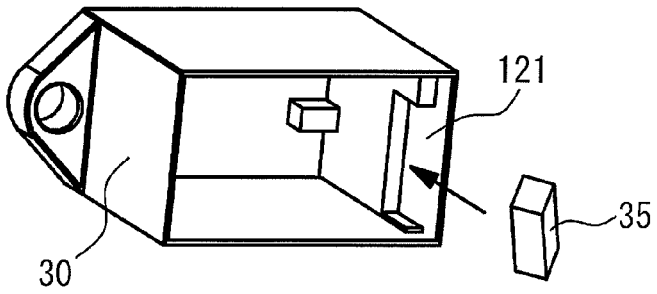
FIG. 12B is a diagram illustrating an example of the outer cover on which a recess for housing the permanent magnet is formed.

In the present embodiment, a projection portion 120 (a third projection portion) for pressing a permanent magnet 35 for the magnetic extinction is provided on the rear surface of the upper cover 10, as illustrated in FIG. 12A. In addition, a recess 121 for housing the permanent magnet 35 is provided on the inner wall of the outer cover 30, as illustrated in FIG. 12B. By sandwiching the permanent magnet 35 between the projection portion 120 and the recess 121, the permanent magnet 35 is fixed. Thereby, the adhesion process required for fixing the permanent magnet 35 to the outer cover 30 can be removed.

A samarium-cobalt magnet which is excellent at maintenance of a residual magnetic flux density, and the usage environment in high temperature is employed as the permanent magnet 35. Thereby, the relay can be downsized, i.e., an implementation area of the relay can be reduced. In a neodymium magnet, the residual magnetic flux density reduces with temperature, for example. Therefore, it is desirable that the above-mentioned samarium-cobalt magnet is employed as the permanent magnet 35.

Seventh Embodiment

A description will be given of a seventh embodiment.

As described above, in the electromagnetic relay 100, the arc space 105 is integrally formed on the upper part of the side surface of the inner cover 51. The arc discharge is extended in the direction of the arc space 105 and is cut off. However, when the direction of the current flowing through the fixed contact 67 and the moving contact 69 is opposite to a direction that the user intends, the arc discharge is extended in the direction opposite to the direction of the arc space 105. In this case, the arc discharge contacts the inner cover 51, and the organic gas causing the contact failure (i.e., poor electrical connection) is generated.

Figure 13A:
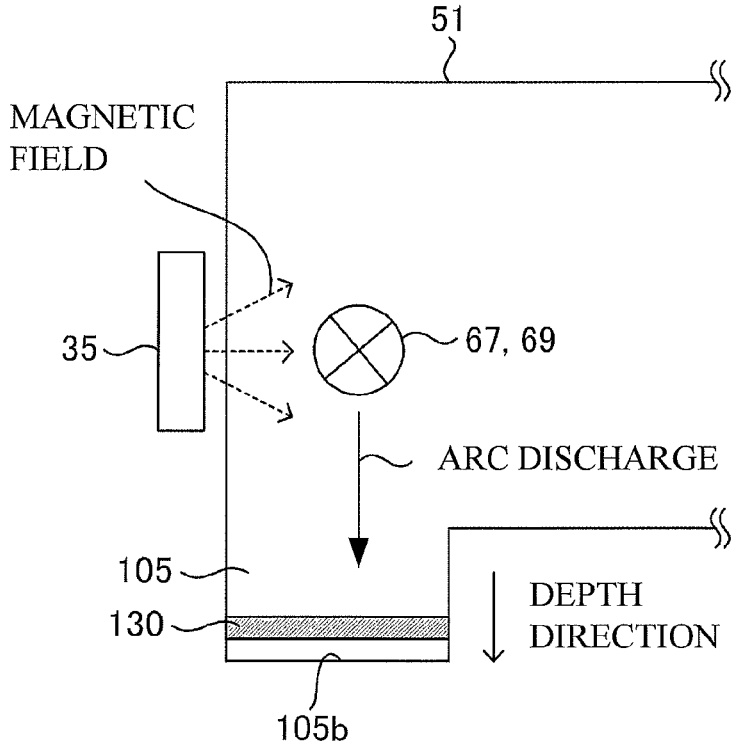
FIGS. 13A and 13B are diagrams illustrating position relationships between arc discharge and the arc space.
Figure 13B:
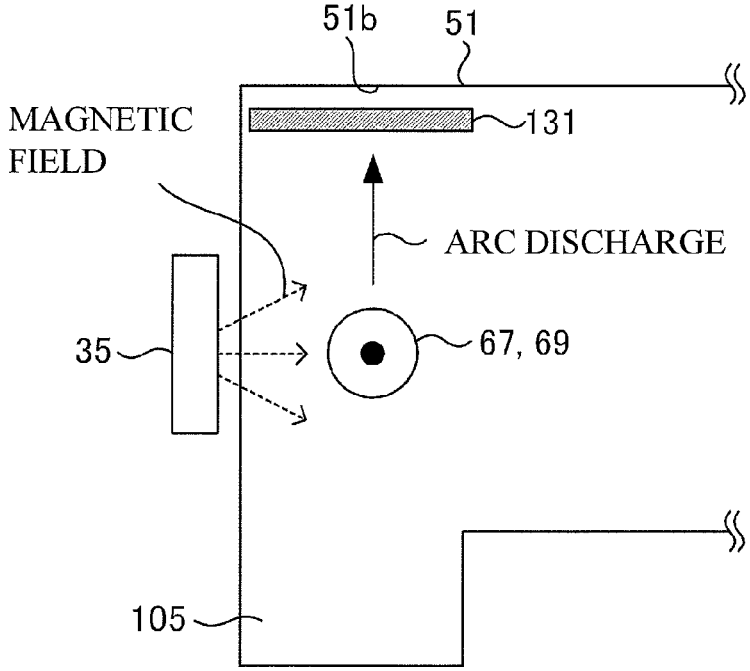

FIGS. 13A and 13B are diagrams illustrating position relationships between the arc discharge and the arc space. In FIG. 13A, the direction of the current flowing through the fixed contact 67 and the moving contact 69 is downward vertically against the page space. In FIG. 13B, the direction of the current flowing through the fixed contact 67 and the moving contact 69 is upward vertically against the page space.

In FIG. 13A, the arc discharge which arises between the fixed contact 67 and the moving contact 69 receives a Lorentz force by a magnetic field from the permanent magnet 35 and is extended in the direction of the arc space 105. In FIG. 13A, a cooling member 130 for cooling the extended arc discharge is provided on the inside of the arc space 105. Specifically, the cooling member 130 is arranged on the inside of the arc space 105 and arranged in a direction perpendicular to the depth direction (i.e., a direction of movement of the arc discharge) of the arc space 105. That is, the cooling member 130 is arranged on the inside of the arc space 105 and arranged in parallel with an inner wall 105*b* of the arc space 105. The cooling member 130 is a metal plate or a ceramic board, for example.

In FIG. 13B, the arc discharge which arises between the fixed contact 67 and the moving contact 69 receives the Lorentz force by the magnetic field from the permanent magnet 35 and is extended in a direction of an inner wall 51*b* of the inner cover 51 opposite to the arc space 105. In FIG. 13B, a cooling member 131 for cooling the extended arc discharge is provided at a position opposite to the arc space 105. Also, the cooling member 131 is arranged in parallel with the inner wall 51*b* of the inner cover 51 or arranged in a direction perpendicular to the direction of movement of the arc discharge. The cooling member 131 may be suspended from the base portion 52 or may be fixed to a member, not shown. The cooling member 131 is a metal plate or a ceramic board, for example. Even when the arc discharge is extended in a direction opposite to the direction of the arc space 105 as illustrated in FIG. 13B, the cooling member 131 can cool the arc discharge and cut off the arc discharge.

In the present embodiment, at least one of the cooling members 130 and 131 may be provided depending on the direction of the current flowing through the fixed contact 67 and the moving contact 69.

In the present embodiment, the cooling member 130 is provided on the inside of the arc space 105 and/or the cooling member 131 is provided at the position opposite to the arc space 105. Therefore, at least one of the cooling members 130 and 131 can cool the arc discharge and cut off the arc discharge. As a result, the opening-and-closing performance of the fixed contact 67 and the moving contact 69 can be improved.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:

a main body including:

a first cover;

an electromagnet having a first terminal extending toward the outside from a bottom surface of the first cover; and a contact portion that opens and closes according to a magnetic attractive force of the electromagnet, and has a second terminal extending toward the outside from the bottom surface of the first cover;

a cable line drawn out to the outside of the electromagnetic relay; and a printed circuit board that fixes the cable line to at least one of the first terminal and the second terminal by dip soldering, and electrically connects the cable line to the at least one of the first terminal and the second terminal.

2. The electromagnetic relay as claimed in claim 1, wherein the printed circuit board includes a first through-hole for inserting the first terminal, a second through-hole for inserting the second terminal, a third through-hole for inserting the cable line, and a circuit that electrically connect at least one of the first through-hole and the second through-hole to the third through-hole.

3. The electromagnetic relay as claimed in claim 1, further comprising:

an upper cover that is placed on an upper surface of the main body; and a second cover that houses the main body, the cable line, and the printed circuit board, and is fixed to the upper cover.

4. The electromagnetic relay as claimed in claim 1, wherein a portion of the printed circuit board which contacts with the cable line is sealed by a protective material.

5. The electromagnetic relay as claimed in claim 4, wherein the protective material is an insulation potting material.

6. The electromagnetic relay as claimed in claim 1, wherein the cable line is at least either one of a metal wire or a metal plate, and is provided between the printed circuit board and a top end of the first cover.

7. The electromagnetic relay as claimed in claim 3, wherein the first cover includes a space for prolonging arc discharge which arises in the contact portion at an upper part of a side surface of the first cover, an upside of the space being opened, and the upper cover includes a first projection portion that projects from a rear surface of the upper cover at a position opposite to the space.

8. The electromagnetic relay as claimed in claim 1, wherein the first cover includes a support portion for supporting the cable line on a side surface adjacent to the cable line.

9. The electromagnetic relay as claimed in claim 8, wherein the support portion is any one of a comb-shaped second projection portion sandwiching the cable line, a tube portion covering the cable line, and a ring portion supporting the cable line at a point.

10. The electromagnetic relay as claimed in claim 3, wherein a vibration absorber for absorbing vibration is provided between the printed circuit board and the second cover.

11. The electromagnetic relay as claimed in claim 10, wherein the vibration absorber is at least one of a spring and a damper.

12. The electromagnetic relay as claimed in claim 3, further comprising:

a magnet for magnetic extinction;

a third projection portion for pressing the magnet provided on a rear surface of the upper cover; and a recess portion for housing the magnet provided on an inner wall of the second cover.

13. The electromagnetic relay as claimed in claim 1, wherein the first cover includes a space for prolonging arc discharge which arises in the contact portion at an upper part of a side surface of the first cover, and a member for cooling the arc discharge is provided on at least one of the inside of the space and a position opposite to the space.

14. An electromagnetic relay, comprising:

a first housing;

an electromagnet enclosed within the first housing and including a first terminal extending toward an outside of the first housing;

a contact enclosed within the first housing, that opens and closes according to a magnetic attractive force of the electromagnet, and has a second terminal extending toward the outside of the first housing;

a printed circuit board to which at least one of the first terminal and the second terminal is soldered;

a second housing in which the first housing and the printed circuit board are enclosed; and a cable line soldered onto the printed circuit board and extending to an outside of the second housing, wherein the cable line and at least one of the first terminal and the second terminal soldered onto the printed circuit board are electrically connected through the printed circuit board to each other.

* * * * *

UNITED STATES PATENT AND TRADEMARK OFFICE

CERTIFICATE OF CORRECTION

PATENT NO. : 8,704,621 B2
APPLICATION NO. : 13/869561
DATED : April 22, 2014
INVENTOR(S) : Hasegawa et al.

It is certified that error appears in the above-identified patent and that said Letters Patent is hereby corrected as shown below:

On the Title Page Item [72] (Inventors), Line 2, delete "Daiel" and insert -- Daiei --, therefor.

Signed and Sealed this
Twenty-second Day of July, 2014

Michelle K. Lee

Michelle K. Lee
*Deputy Director of the United States Patent and Trademark Office*